US006780143B2

(12) United States Patent
Copeland

(10) Patent No.: US 6,780,143 B2
(45) Date of Patent: Aug. 24, 2004

(54) ECCENTRIC CYCLING TRAINER

(76) Inventor: Victor Z. Copeland, 11115 SE. 23rd St., Vancouver, WA (US) 98664

( * ) Notice: Subject to any disclaimer, the term of this patent is extended or adjusted under 35 U.S.C. 154(b) by 298 days.

(21) Appl. No.: 10/036,549

(22) Filed: Dec. 31, 2001

(65) Prior Publication Data

US 2003/0125167 A1 Jul. 3, 2003

(51) Int. Cl.[7] ..... A63B 69/16
(52) U.S. Cl. ..... 482/61; 482/63
(58) Field of Search ..... 482/57, 60, 58, 482/59, 61, 63, 65; 434/61, 67

(56) References Cited

U.S. PATENT DOCUMENTS

| | | | | |
|---|---|---|---|---|
| 4,930,770 A | * | 6/1990 | Baker | 482/95 |
| 5,015,926 A | * | 5/1991 | Casler | 318/9 |
| 5,460,585 A | * | 10/1995 | Gentry et al. | 482/1 |
| 5,944,637 A | | 8/1999 | Stickler et al. | |
| 6,042,517 A | | 3/2000 | Gunther et al. | |
| 6,270,445 B1 | * | 8/2001 | Dean et al. | 482/4 |

OTHER PUBLICATIONS

"Eccentric Muscle Action Increases Site–Specific Osteogenic Response", S.A. Hawkins, et al., SportMed Update, Apr. 2000 (2 pages).

"Chronic Eccentric Exercise: Improvements in Muscle Strength Can Occur with Little Demand for Oxygen", P.C. Lastaya, et al., Abstract, American Journal of Physiology, Feb., 1999 (2 pages).

"Make Sure to Lower the Weights you Lift . . . ", C.A. Weber, Muscular Development Magazine, date unknown, (2 pages).

"Accentuate the Negative", A Jones, IronMan, Jan. 1973, vol. 32, No. 2, (11 pages).

"Eccentric Ergometry: Increases in Locomotor Muscle Size and Strength at Low Training Intensities" P.C. Lastayo, et al., Abstract, American Journal of Physiology, May, 2000, vol. 278, Issue 5 (15 pages).

* cited by examiner

*Primary Examiner*—Nicholas D. Lucchesi
*Assistant Examiner*—Tam Nguyen
(74) *Attorney, Agent, or Firm*—Stetina Brunda Garred & Brucker

(57) ABSTRACT

An eccentric cycling trainer assembly for use with a conventional cycle comprises first and second frame members connected to each other to define a wheel-receiving body and including the assembly wheel-rotating unit. The wheel-rotating unit rotates the rear wheel of the cycle in a counter-pedaling direction whereby the trainee can then apply an opposition rotational force upon the cycle's pedals in a pedaling direction as the rear wheel continues to rotate thereby providing an eccentric muscular exercise.

14 Claims, 3 Drawing Sheets

Fig. 1
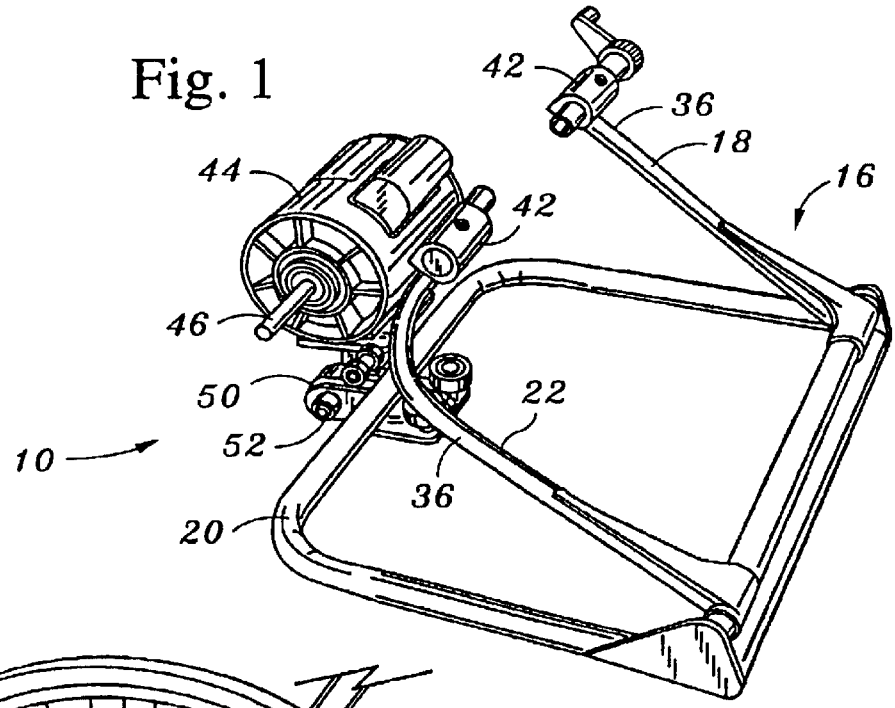
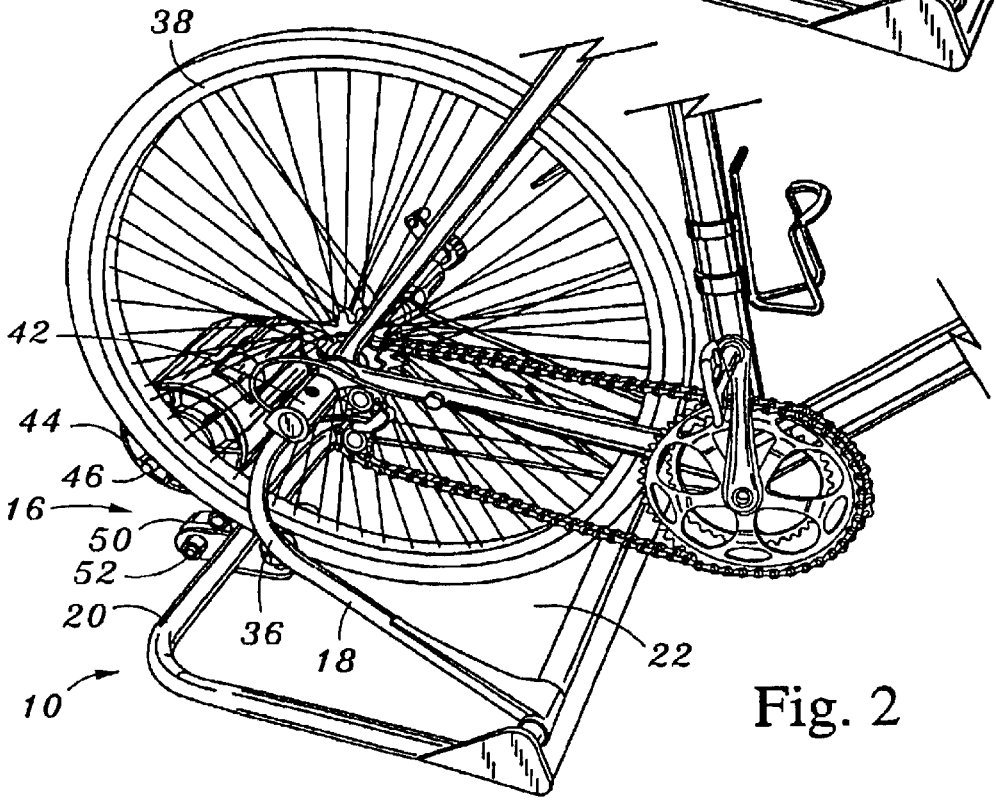
Fig. 2

ECCENTRIC CYCLING TRAINER

CROSS-REFERENCE TO RELATED APPLICATIONS (Not Applicable)

STATEMENT RE: FEDERALLY SPONSORED RESEARCH DEVELOPMENT (Not Applicable)

BACKGROUND OF THE INVENTION

The present invention relates generally to cycling trainer assemblies, and more particularly to an improved cycling trainer assembly utilizing a motive force such as a motor to rotate the rear wheel of the cycle in a direction opposite to the pedaling direction. A trainee eccentrically exercises specific leg muscles utilized for cycling by resisting such rotation by applying a counter rotational force upon the cycle's pedals.

It is common knowledge that pedaling strength and power are essential factors in creating greater cycling performance. As such, a typical cyclist who tries to improve performance trains endlessly to develop superior muscular pedaling strength and power. Because pedaling strength and power are acquired when leg muscles produce force, the competition cyclist often performs extensive leg exercise and weight training. Put simply, the greater the force produced by the cyclist's leg muscles, the more they gain in pedaling strength and power.

Muscle strength development correlates directly to the intensity of the exercise. For example, more strength is gained by lifting heavy weights than by lifting light weights. There are three different types of muscular action: concentric, isometric, and eccentric. In general, a concentric muscular contraction/exercise occurs when the muscle fibers shorten while producing force. An isometric muscular contraction/exercise is defined when the muscles contract against a fixed object and there is no change in the muscle fibers' length. Lastly, an eccentric muscular exercise occurs when the muscle fibers lengthen while producing force. The understanding of how the muscles produce force plays a significant role in developing superior pedal strength and power.

Eccentric exercise has the potential of producing much greater strength in muscles than a concentric exercise. More particularly, it is found that the muscles can develop 20% to 70% more power during eccentric exercise than concentric exercise. In this regard, eccentric muscular exercises have the ability to overload the muscles to a much greater degree than concentric muscular exercises. Consequently, the eccentric muscular exercises result in greater strength and power than the concentric muscular exercises, and they are accomplished with less perceived effort and lower heart rate.

Various types of prior art cycling trainer assemblies are currently being used to enhance cycling performance. However, these prior art assemblies are all designed for concentric muscular exercises, and are totally devoid of providing any meaningful eccentric muscular exercises. One example of such prior art cycling trainer assembly is disclosed in U.S. Pat. No. 4,768,782, entitled "Bicycle Exercising Apparatus," and issued to James Blackburn on Sep. 6, 1988, the disclosure of which is expressly incorporated herein by reference. In that patent, a cycling trainer assembly which is used to support a cycle's rear wheel is described. The rear wheel rotates upon a roller along a pedaling direction, and the assembly comprises a fan resistance device that applies a resistive force to the rotation of the roller. In this respect, the fan resistance device impedes the rotation of the rear wheel and thereby provides exercise to its user.

Other prior art cycling trainer assemblies utilize a magnetic brake in lieu of the fan resistance device to provide an adjustable braking force to the cycle's rear wheel. A typical example of such assembly is disclosed in U.S. Pat. No. 4,826,150, reissued as reissue Pat. No. Re. 34,479, entitled "Resistance Applying Means For Exercising Apparatus," and reissued to Chihiro Minoura on Dec. 14, 1993, the disclosure of which is expressly incorporated herein by reference. Moreover, some prior art assemblies resort to hydraulic-based resistance devices to impede the rotation of the cycle's rear wheel.

All of the above-mentioned prior art cycling trainer assemblies only provide concentric muscular exercises as they merely provide resistive forces necessary to impede the rotation of the cycle's wheel along the normal forward pedaling direction. There is no eccentric muscular exercise being performed when using these prior art assemblies. Certainly, due to the limitations in their structures and functions, the prior art assemblies fail to exercise the leg muscles eccentrically and thereby do not produce the muscular strength development that is possible through eccentric exercise.

In view of the above-described shortcomings of the prior art cycling trainer assemblies, there exists a need in the art for a cycling trainer assembly which can readily provide both concentric and eccentric muscular exercises. More specifically, there exists a need for a cycling trainer assembly which can optimally and specifically provide the eccentric muscular exercise to the leg muscles that are necessary for maximum cycling strength.

BRIEF SUMMARY OF THE INVENTION

The present invention specifically addresses and alleviates the above-referenced deficiencies associated with the use of cycling trainer assemblies of the prior art. In particular, the present invention comprises an improved cycling trainer assembly which is adapted to optimally provide either or both concentric and eccentric exercises to leg muscles. More particularly, the specific assembly of the present invention is capable of concentrating upon such leg muscles and eccentrically exercise the same. In this respect, the present invention's cycling trainer assembly recognizes that greater exercise intensity can be supported during eccentric actions of the leg muscles, and thus renders an intense eccentric muscular exercise so as to efficiently raise the overall cycling exercise performance.

In accordance with a preferred embodiment of the present invention, there is provided a cycling trainer assembly which affords an optimal eccentric muscular exercise to the legs of a trainee. The assembly of the present invention comprises first and second frame members connected to each other to define a wheel-receiving body. Preferably, these frame members are each fabricated from a tubular metallic material and are pivotally connected to each other in a way that the first frame member can transition between stowed and operative positions with respect to the second frame member. Moreover, the first frame member comprises two arcuate end portions which jointly define a lock mechanism thereat. As will be demonstrated below, this lock mechanism is used to securely engage a rear wheel of a cycle.

In the preferred embodiment of the present invention, a wheel-rotating unit, i.e. a motive force provider, is attachable to the second frame member. The wheel-rotating unit includes an elongated rotatable shaft configured to contact the rear wheel of the cycle and rotate the same opposite to the normal pedaling direction ("counter-pedaling direction") preferably between a plurality of adjustable rotational speeds. The wheel rotating unit of the present invention is preferably implemented as an electric motor, however, it will be recognized herein that any devices which provide rotational motions along the counter-pedaling direction may be used in lieu of the electric motor (e.g., a pneumatic or a hydraulic device). Further, in the preferred embodiment, the wheel-rotating unit is engaged to the frame in a removable and/or releasable manner for the reasons that will be clear below.

In operation, the trainee may simply lock in the rear wheel of the cycle to the lock mechanism when the first frame member is disposed in an operative extended "up" position. Then, the first frame member is pivoted downwardly toward a "down" position such that an outer periphery of the cycle rear wheel contacts the rotatable shaft of the motor. Upon such contact, the trainee can activate the motor to rotate the rotatable shaft which causes the rear wheel and pedals to rotate in the counter-pedaling direction. This rotation is facilitated by the weight of the trainee riding upon the cycle whereby sufficient frictional force between the rotatable shaft and cycle tire is achieved. Thereafter, the trainee conducts an eccentric leg muscular exercise by attempting to resist the backward rotation of the rear wheel by applying a standard forward pedaling force upon the pedals in the usual pedaling direction. The trainee repeats the application of regularly forward pedaling force upon the pedals in the normal pedaling direction as the rear wheel and pedals are continuously caused to rotate in reverse.

The present invention additionally may allow the trainee to switch to an alternate mode of providing a concentric leg muscular exercise. More specifically, the trainee may simply remove the wheel-rotating unit from the second frame member and install a conventional mechanical braking device in its place (e.g., magnetic, pneumatic, and hydraulic devices). The mechanical braking device provides desired conventional resistive force to the rotation of the rear wheel in the pedaling direction. In this respect, the trainee pedals against the resistive force to thereby concentrically exercise the trainee's leg muscles. Of course, the mechanical braking device can be replaced with the wheel-rotating unit when the trainee desires for an eccentric leg muscular exercise.

BRIEF DESCRIPTION OF THE DRAWINGS

These as well as other features of the present invention will become more apparent upon reference to the drawings wherein:

FIG. 1 is a perspective view of a cycling trainer assembly for providing an eccentric leg exercise constructed in accordance with a preferred embodiment of the present invention;

FIG. 2 is a perspective view of the cycling trainer assembly shown in FIG. 1 when it is utilized with a conventional cycle;

DETAILED DESCRIPTION OF THE INVENTION

Figure 3:
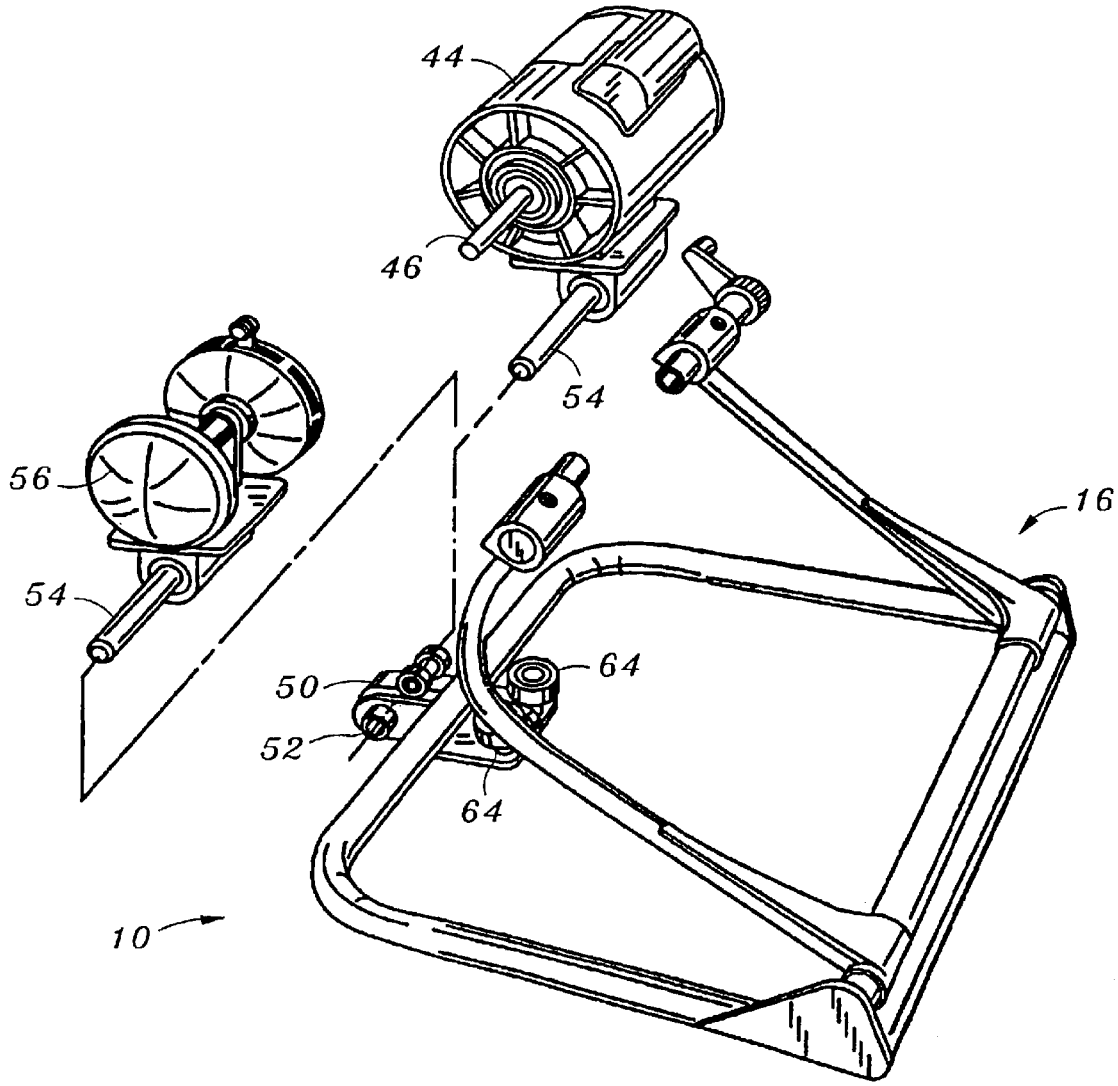
FIG. 3 is a perspective view of the cycling trainer assembly shown in FIG. 1 and illustrating its adaptability to utilize a wheel-rotating unit or a magnetic brake to respectively alternate between providing an eccentric exercise and a concentric exercise.

Referring now to the drawings wherein the showings are for purposes of illustrating preferred embodiments of the present invention only, and not for purposes of limiting the same, FIG. 1 perspectively illustrates a cycling trainer assembly 10 constructed in accordance with a preferred embodiment of the present invention. As indicated above, the cycling trainer assembly 10 is adapted to provide either or both concentric and eccentric muscular exercises to legs 12 of a trainee 14 (shown in FIG. 4). Those of ordinary skill in the art will recognize that the cycling trainer assembly 10 may be formed to have a variety of shapes, configurations, geometries and sizes other than for that shown in the provided figures.

Referring more particularly to FIGS. 1 and 3, the cycling trainer assembly 10 of the present invention includes a wheel-receiving body or stand 16 composed of a first frame member 18 and a second frame member 20. Although the wheel-receiving body 16 is specifically shaped and configured as shown in those figures, such depiction is exemplary in nature and should not be limited thereto.

The first and second frame members 18, 20 are each preferably fabricated from a metallic or composite tubular material. However, one of ordinary skill in the art would recognize that these frame members 18, 20 may be made from any substance which yields sufficiently rigid frame structures. The first and second frame members 18, 20 are preferably pivotally connected to each other so that the first frame member 18 can move between an operative extended "up" position 22 and a flat stowed "down" position with respect to the second frame member 20. However, those skilled in the art will recognize that the frame members may be rigidly affixed to one another.

The first frame member 18 preferably includes two arcuate end portions 36 which define a space or region where a rear wheel 38 of a cycle 40 can be placed therebetween. Moreover, the two arcuate end portions 36 include a conventional quick connect wheel lock mechanism 42 thereat which is operative to selectively secure the rear wheel 38 of the cycle to the first frame member 18 (best shown in FIG. 2).

A wheel-rotating unit 44 is engaged to the second frame member 20. The wheel-rotating unit 44 includes an elongated rotatable shaft 46 configured to provide a rotation force in a direction opposite to the pedaling direction 48 ("counter-pedaling direction"). The unit 44 preferably comprises an electric motor; however, one of ordinary skill in the art will appreciate that any devices which provide a rotational force in the counter-pedaling direction 48 may be used in lieu of the electric motor (e.g., a pneumatic or a hydraulic motor). Further, in the preferred embodiment, the unit 44 may include a rotational speed controller to vary the rotational speed of the output shaft.

The wheel-rotating unit 44 is preferably removably mounted to the second frame member 20. More particularly, the second frame member 20 comprises a unit receiving member 50. The unit receiving member 50 has a shaft receiving portion 52. In this respect, an elongated engaging shaft 54 of the wheel-rotating unit 44 may be axially slid through the shaft receiving portion 52 and be removably secured thereto. Likewise, any conventional mechanical resistance brake for providing concentric exercises, such as a magnetic brake 56 (shown in FIG. 3 by way of example only), may be engaged to the unit receiving member 50 in the same manner when the wheel-rotating unit 44 is removed therefrom. Although not required, the unit receiving member 50 may further include a pair of guide bearings 64 for preventing the rear wheel 38 from slipping when it is placed in abutting contact with the rotatable shaft 46. Alternatively, the wheel rotating unit can be mounted to the frame members to move upwardly and downwardly toward the rear wheel of the bicycle.

Figure 4:
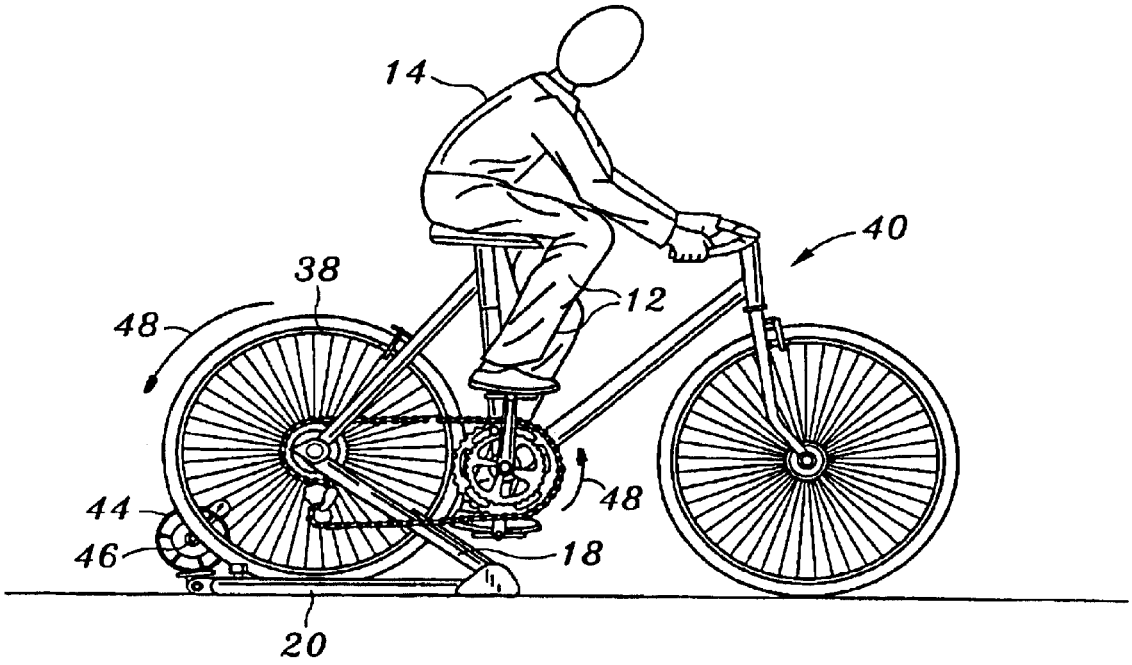
FIG. 4 is a side view of the cycling trainer assembly shown in FIG. 2 to illustrate an exemplary eccentric leg exercise provided to a trainee.

In operation, as shown in FIGS. 2 and 4, the trainee 14 may simply lock in the rear wheel 38 of the cycle 40 to the lock mechanism 42 when the first frame member 18 is disposed in its operative "up" position 22. Thereafter, the first frame member 18 may be pivoted downwardly toward the second frame member 20 such that an outer periphery 58 of the rear wheel 38 of the cycle is placed in abutting contact with the elongated rotatable shaft 46. Upon such contact, the trainee 14 can then activate the rotatable shaft 46 via an on/off switch and or speed controller interfaced to the motor and preferably mountable to the handle bards of the cycle which causes the rear wheel 38 (and also the pedals 60) to rotate in the counter-pedaling direction 48. This rotation 48 is facilitated by the weight of the trainee 14 and cycle 40 being pivotally exerted upon the rotating shaft of the motor. As such, the trainee 14 can now conduct an eccentric leg muscular exercise when the trainee attempts to resist the rotation of the rear wheel 38 by applying force upon the pedals 60 in the pedaling direction 62. The trainee 14 continues applying a resistive force upon the pedals 60 in the pedaling direction 62 as the rear wheel 38 is continuously caused to rotate in the reverse direction 48.

If desired, the trainee 14 may convert the present invention to provide conventional concentric leg muscular exercise. Specifically, the trainee 14 may simply withdraw the wheel-rotating unit 44 from the unit receiving member 50 and engage a conventional mechanical braking device in its place (e.g., magnetic, pneumatic, and hydraulic devices). As is well known, such mechanical braking device provides a sufficient resistive force to the rotation of the rear wheel 38 in the pedaling direction 62. Upon such occurrence, the trainee 14 has to pedal against the resistive force to thereby concentrically exercise his/her legs 12. Of course, the mechanical braking device can be replaced with the reverse wheel-rotating unit 44 when the trainee 14 desires for an eccentric leg muscular exercise.

Those skilled in the art will recognize that the eccentric cycling trainer of the present invention is user specific, i.e allowing a particular trainee to utilize the trainee's own bike on the exercise apparatus. As such, the present invention allows the trainee to exercise in actual competitive cycling positions as utilized during a desired cycling event. Further, the present invention is portable in nature, whereby the frame member 18 may be pivoted downward to a stowed position in a orientation generally coplanar with the base member 20 whereby the same can be easily placed in a vehicle. Further, the present invention allows for both eccentric as well as concentric exercise which heretofore has been totally devoid in the prior art.

Additionally as previously mentioned, the present invention may include a conventional motor controller which may be electrically interfaced via telephony or hard wiring techniques to the motor 44. Additionally, such controller may include a conventional digital readout, timer, speedometer, calorie/watt meter and the like to allow the user to visually monitor the extent of exercise.

Additional modifications and improvements of the present invention may also be apparent to those of ordinary skill in the art. For instance, the eccentric training of the present invention may be incorporated or retrofitted on to conventional stationary gym model exercise cycling equipment. Further, those skilled in the art will recognize that by changing the rotational direction of the output shaft of the motor to rapidly spin the pedals of a fixed gear cycle, the present invention may be effectively utilized to provide training for high-speed pedaling (i.e., spinning). Thus, the particular combination of parts described and illustrated herein is intended to represent only certain embodiments of the present invention, and is not intended to serve as limitations of alternative devices within the spirit and scope of the invention.

What is claimed is:

1. A cycling trainer assembly for use with a cycle to provide an eccentric muscular exercise to legs of a trainee, the cycle having a rear wheel and pedals, the assembly comprising:

first and second frame members connected to each other to define a wheel-receiving body;

means for mounting the rear wheel of the cycle to the first frame member; and a wheel-rotating unit engaged to the second frame member configured to rotate in a counter-pedaling direction to provide the eccentric muscular exercise when a trainee provides a force to rotate the rear wheel in a pedaling direction.

2. The assembly of claim 1 wherein the first and second frame members are each fabricated from a metallic material.

3. The assembly of claim 1 wherein the first and second frame members are pivotally connected to each other.

4. The assembly of claim 3 wherein the first frame member is movable between up and down positions with respect to the second frame member.

5. The assembly of claim 1 wherein the wheel-rotating unit is an electric motor.

6. The assembly of claim 1 wherein the wheel-rotating unit is removably engaged to the second frame member.

7. The assembly of claim 6 wherein the wheel-rotating unit comprises an elongated engaging shaft and a unit receiving member that comprises a shaft receiving portion, the engaging shaft of the wheel-rotating unit being axially slidable through the shaft receiving portion and be secured thereto.

8. The assembly of claim 1 further comprising a magnetic brake for providing a concentric muscular exercise to the legs of the trainee, the magnetic brake being engageable to the unit receiving member when the wheel-rotating unit is removed therefrom.

9. The assembly of claim 8 wherein the magnetic brake comprises an elongated engaging shaft and the unit receiving member comprises a shaft receiving portion, the engaging shaft of the magnetic brake being axially slidable through the shaft receiving portion and be secured thereto.

10. The assembly of claim 7 wherein the wheel-rotating unit is configured to rotate the rear wheel at a plurality of adjustable rotational speeds.

11. A method of utilizing a cycling trainer assembly with a cycle to provide an eccentric muscular exercise to trainee's legs, the cycle having a rear wheel and pedals, the method comprising the steps of:

a) engaging the rear wheel to the cycling trainer assembly;

b) rotating the rear wheel in a counter-pedaling direction with the cycling trainer assembly; and c) applying pressure upon the pedals in a pedaling direction with the trainee's legs as the rear wheel and pedals rotate in a counter-pedaling direction so as to provide the eccentric muscular exercise to the trainee's legs.

12. The method of claim 11 wherein step a) comprises:

1) defining a wheel-receiving body with a lock mechanism of the cycling trainer assembly;

2) positioning the rear wheel of the cycle adjacent to the lock mechanism; and 3) engaging the rear wheel to the wheel-receiving body securely with the lock mechanism.

13. The method of claim 11 wherein step b) comprises:

1) defining a wheel-receiving body with a wheel-rotating unit of the cycling trainer assembly;

2) rotating an elongated rotatable shaft of the wheel-rotating unit in the counter-pedaling direction;

3) placing an outer periphery of the rear wheel in abutting contact with the rotatable shaft; and 4) rotating the rear wheel in the counter-pedaling direction with the rotatable shaft.

14. The method of claim 12 wherein step 2) comprises:

i) rotating the rotatable shaft at a plurality of adjustable rotational speeds.

* * * * *